US012152403B2

(12) United States Patent
Kusser

(10) Patent No.: US 12,152,403 B2
(45) **Date of Patent: *Nov. 26, 2024**

(54) NATURAL STONE SWIMMING POOL

(71) Applicant: Josef Kusser GmbH & Co. KG, Aicha vorm Wald (DE)

(72) Inventor: Georg Kusser, Aicha vorm Wald (DE)

(73) Assignee: Josef Kusser GmbH & Co. KG, Aicha vorm Wald (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/296,831

(22) Filed: Apr. 6, 2023

(65) Prior Publication Data

US 2024/0018794 A1 Jan. 18, 2024

Related U.S. Application Data

(63) Continuation of application No. 17/598,705, filed as application No. PCT/EP2020/058371 on Mar. 25, 2020, now Pat. No. 11,634,920.

(30) Foreign Application Priority Data

Mar. 26, 2019 (EP) ..... 19165289

(51) Int. Cl.
*E04H 4/00* (2006.01)
*E04H 4/12* (2006.01)

(52) U.S. Cl.
CPC ..... *E04H 4/00* (2013.01); *E04H 4/12* (2013.01)

(58) Field of Classification Search
CPC ..... E04H 4/00; E04H 4/12
USPC ..... 4/506
See application file for complete search history.

(56) References Cited

FOREIGN PATENT DOCUMENTS

DE 2017456 A1 * 11/1971
WO WO-2007029277 A1 * 3/2007 ..... E04H 4/00

* cited by examiner

*Primary Examiner* — Christine J Skubinna
(74) *Attorney, Agent, or Firm* — Thorpe North & Western, LLP; David W. Osborne

(57) ABSTRACT

The present invention relates to a pool for receiving one or more people for carrying out sports or relaxation activities, also referred to as a swimming pool, comprising at least one baseplate and a boundary wall, wherein the baseplate and the boundary wall enclose an internal volume, and the baseplate and the boundary wall are each constructed from one or more monolithic natural stones, and said monolithic natural stones are interconnected to one another, within the baseplate, the boundary wall and at the connecting surfaces between baseplate and boundary wall, in an integrally bonded and watertight manner. The invention furthermore relates to the use of such a pool as a swimming pool, and to a method for producing such a pool.

13 Claims, 5 Drawing Sheets

NATURAL STONE SWIMMING POOL

TECHNICAL FIELD

The present invention relates to a pool for receiving one or more people for carrying out sports or relaxation activities, also referred to as a swimming pool or whirlpool, with at least one baseplate and a boundary wall, wherein the baseplate and the boundary wall enclose an internal volume of the pool. The invention furthermore relates to the use of such a pool as a swimming pool, and to a method for producing such a pool.

PRIOR ART

Swimming pools are generally very popular for sports activities and also for cooling relaxation for young and old on hot days. Accordingly, there are many different sizes and designs of swimming pools. These can include swimming pools embedded in the ground, for example in the soil of a garden, such that the surface of the water in the swimming pool is virtually at the same height as the surrounding ground. Alternatively, there are structural forms which are not embedded in the ground, but rather are constructed protruding upward from the ground. In the case of these structural forms, the water surface lies at a correspondingly greater height than the surrounding ground. In the case of swimming pool designs which are embedded in the ground, the sidewalls firstly have to absorb, from the inside, the water pressure of the water located in the swimming pool and secondly, from the outside, the pressure of the surrounding ground or soil. In the case of the swimming pools constructed in a manner protruding upward from the ground, the sidewalls thereof during use have to absorb the water pressure produced by the water located in the swimming pool. Thus, in the case of all constructional forms of swimming pools, high requirements are placed on the strength, in particular on the strength of the sidewalls of the swimming pools.

In addition to the necessary strength, as described above, there are also further essential requirements demanded of swimming pools. The materials used for a swimming pool are intended to be stable in relation to the water which is located in the swimming pool and which is generally chlorinated in order to prevent the proliferation of germs. The surfaces coming into contact with the water therefore have to be chemically stable. Furthermore, the surfaces are intended to be created in such a manner that they are firstly easy to clean and secondly provide a good grip for a user as the user enters the swimming pool. The surfaces are customarily walked on barefoot by users and often with wet feet, as a result of which there is a risk of injury due to slipping and the like if surfaces are smooth. Furthermore, the surfaces located underwater are also intended to have properties providing a good grip in order, for example, to enable the user to push off during swimming or during other activities in the pool, for example during ball games or when diving. Natural stone surfaces have turned out to be particularly suitable here for swimming pools, since the surface structure of the natural stone surfaces can be set to a suitable roughness by appropriate machining and said surfaces also produce an extremely high-quality impression and feel natural to swimming pool users.

Prior art concerned with the abovementioned requirements has already been known for a long time in the field of swimming pools and swimming pool production. For example, it is known from German patent application DE 10

2006 049 023 A1, for the production of swimming pools with natural stone surfaces, first of all to provide a load-bearing basic structure made from concrete and then to apply a visible surface made from natural stone to the substructure made of concrete. This application takes place with the aid of reinforcing means, for example screws. Furthermore, a swimming pool is known from Chinese utility model CN 203050160 U, in which individual parts made from granite are fastened to a load-bearing basic body by means of steel pins. These granite parts are applied only on the inwardly facing side of the basic body. Finally, European patent application EP 1 760 225 A1 discloses a modularly constructed swimming pool which has a load-bearing structure by means of panels made from composite materials. Natural stone surfaces can subsequently be applied to said load-bearing structure.

The publication WO 2007/029277 A1 discloses various embodiments of artificial water pools. Some of these embodiments are provided with final surfaces composed of natural stone. The water pools disclosed all have a multi-layered construction and are sealed in particular by a watertight film. Furthermore, DE 2017456 A discloses a swimming pool in which a visible surface made from stone is applied to a load-bearing structure made from metal parts in the interior. The load-bearing structure made from metal parts comprises both the base and the sidewalls of the swimming pool.

However, the multi-layered and thus complicated construction of swimming pools with natural stone surfaces is entirely a disadvantage of the prior art already known in this technical field, as described above. Furthermore, among other substantial disadvantages of said swimming pools which are already known are connecting elements which are constantly at risk of corrosion and which do not have properties stable over the long term due to their tendency to corrode.

It is therefore the object of the present invention to propose a solution with which a robust natural stone surface swimming pool which is stable over the long term and has a simplified overall structure can be provided.

SUMMARY OF THE INVENTION

The abovementioned object of the invention is achieved by a pool for receiving one or more people for carrying out sports or relaxation activities, with at least one baseplate; a boundary wall, wherein the baseplate and the boundary wall enclose an internal volume which can be filled with water during operation of the pool; and a treatment plant which is provided for treating the water located in the internal volume, wherein the treatment plant comprises an inlet connected to the internal volume, an outlet connected to the internal volume, and a treatment element arranged in the flow direction of the water between inlet and outlet. The baseplate and the boundary wall are each constructed here from one or more monolithic natural stones, wherein the monolithic natural stones are interconnected to one another, within the baseplate, the boundary wall and at the connecting surfaces between baseplate and boundary wall, in an integrally bonded and watertight manner, in particular by an adhesive bonded joint. In addition, the baseplate is formed together with the boundary wall to absorb the pressure produced by the water located in the internal volume during operation of the swimming pool, while maintaining the watertightness, without a load-bearing substructure provided additionally to the boundary wall being necessary. In addition, the internal volume has a depth of at least 0.5 m, a free internal length of at least 2 m, and a free internal width of at least 2 m, wherein the free internal length is arranged at a right angle to the free internal width. According to a preferred embodiment of the present invention, the pool according to the invention has a free length and a free width arranged at a right angle thereto. "Free length" and "free width" should be understood here as meaning in each case the maximum internal dimensions of the internal volume in the corresponding direction. The depth of the internal volume is defined at a right angle to the free width and free length.

The pool according to the invention correspondingly has dimensions which correspond at least to the dimension: free length×free width×depth=2 m×2 m×0.5 m. A further favorable depth for a pool according to the invention is a depth of at least 1 m. From said depth, swimming movements in the water in the interior of the pool can be carried out even by adults. A further favorable free length for a pool according to the invention is a length of at least 3 m. By means of a pool designed in such a manner, a robust natural stone surface swimming pool which is stable over the long term and which has a simplified overall structure can be provided which thus provides a solution to the abovementioned problem and avoids the disadvantages of the prior art.

According to a preferred embodiment, the pool according to the invention can comprise a pool shell which surrounds an internal volume in a watertight manner. During operation of the pool, in particular during use of the pool as a swimming pool, the internal volume mentioned is filled with water. The pool shell is formed downward by a baseplate and at the sides by a boundary wall. Openings or cutouts for installations that are required for the operation of the pool as a swimming pool or whirlpool can be provided here in the baseplate and in the boundary wall. Such installations can be, for example, inlets and outlets, spotlights, speakers or the like.

As described above, a treatment plant is provided for cleaning and treating the water in the pool. Said treatment plant conventionally operates continuously during operation of the pool. The actual cleaning of the water takes place here by or in a treatment element. Said treatment element comprises a pump which transports water out of the internal volume to the treatment element and back out of the treatment element into the internal volume again. The treatment element here is provided with at least one filter which filters impurities and suspended matter out of the water. In addition to the filter, further components can be provided for cleaning or treating the water, for example a disinfection plant, a flocculation plant or the like. The connection from the internal volume to the treatment element is formed by an inlet which can be designed, for example, as a pipe. However, other embodiments of an inlet, as described further below, are also conceivable. The connection which brings the cleaned water back out of the treatment element into the internal volume is the outlet which is conventionally designed as a pipe.

According to the invention, the pool shell, i.e. the combination of baseplate and boundary wall, is constructed exclusively from natural stones which are interconnected in an integrally bonded and watertight manner. A substantial difference of the invention over the prior art here is that there is no load-bearing substructure for the pool. This obviates the need for many working steps which are required for constructing pools known from the prior art. In comparison to the pools from the prior art, the pool according to the invention furthermore has only a single layer of natural stones in the thickness direction of the boundary wall. The baseplate also consists correspondingly merely of a single layer of natural stones. This design obviates the need for all the working steps which are required for the construction of a separate substructure and the working steps for retrospectively applying the natural stone surface to the substructure. Of course, a pool according to the invention can also be constructed on a substructure which is possibly already present. In the case of particularly large pools, a new construction can also be undertaken on a substructure which is formed, for example, by a concrete slab. The use of such a substructure facilitates, inter alia, a horizontal orientation of the pool. At the same time, the entire pool shell is exclusively composed of high-value natural stone which, in particular in the case of a pool made from granite, is very stable over the long term to environmental influences and chemicals. A pool according to the invention is therefore very robust and durable. The solid construction from natural stones means that a pool according to the invention has a natural stone surface on all of its surfaces, which has a completely high-quality and pleasing effect for every user. At the same time, the natural stone surface provides tactility which is very pleasant and nevertheless has a good grip, as a result of which a completely high-quality impression haptically also arises for the user. The natural stone surface roughness provided on the entire pool surface can be set in such a manner that the optimum roughness is provided both for the discussed grippiness and also for good suitability for cleaning. To clarify: a very smooth surface may well be readily cleaned, but does not provide a good grip nor a haptically attractive overall impression. By contrast, a very rough surface may well provide a very good grip, but is difficult to clean since it can be difficult to detach dirt from a very rough surface. The roughness of natural stone surfaces of the pool according to the invention can, however, be set precisely, for example by grinding, as to correspond to the anticipated requirements and as the user wishes.

The pool shell here is constructed from monolithic natural stones. Monolithic should be understood here as meaning that the individual natural stones are each composed only of a stone obtained, for example, in a quarry. Monolithic natural stones have a very high strength since there are no separating or connecting points within said stones. Specifically when granite is used as natural stone, such monolithic natural stones can absorb very great stresses, as a result of which a pool shell, as described above, can be entirely of thin-walled dimensions, thus producing a very slender impression of the pool. In addition, such a slender dimensioning produces a very high-quality overall impression, in particular in comparison to a multi-layered construction, as is proposed in the case of the swimming pools of the above-described prior art.

In the case of the pool here according to the invention, the monolithic natural stones which form the baseplate and the boundary wall are preferably interconnected to one another in an exclusively integrally bonded manner, i.e. without the use of additional form-fitting or force-fitting connecting elements. In particular, the individual monolithic natural stones can be interconnected by a thin adhesive layer which at the same time provides a seal between the individual natural stones. A particular advantage of such an integrally bonded adhesive bonded joint is that the latter can scarcely be seen, and therefore the pool according to the invention gives the impression of being composed completely and integrally from natural stone. The adhesive used for such a connection is mostly located between the natural stones and is thus exposed neither to light nor UV radiation, as a result of which the adhesive bond provides properties which are stable over the long term. According to the invention, the entire pool shell is thus constructed exclusively from robust and high-quality materials. It has surprisingly been found by the inventors of the present invention that such a construction, even without the load-bearing substructure known from the prior art, is capable of absorbing the forces, which are produced by the water in the internal volume, on the boundary wall and the baseplate. The boundary wall of the pool has sufficient strength even without an additional, load-bearing supporting structure, in order by itself to absorb the forces resulting from the water pressure in the internal volume of the pool. The high strength of natural stone in conjunction with a correspondingly selected, integrally bonded adhesive bond makes it possible for the pool shell to thereby be configured with an extremely slender visual impression, which results in a hitherto unknown impression for the observer's eye. This slender construction is highly attractive, specifically in the case of pools arranged protruding upward above the ground, and produces an exclusive impression.

According to one embodiment of the invention, it is provided that the boundary wall is of a rectangular configuration, in a top view of the pool, and is constructed from two longitudinal sidewalls and two wide sidewalls. The longitudinal sidewalls and the wide sidewalls are preferably arranged at a right angle to one another and to the baseplate. According to this embodiment, the internal volume formed by the pool shell is cuboidal and bounded on all sides by flat walls. In an alternative embodiment thereto, it is provided that the boundary wall has, in a top view of the pool, a round, oval or polygonal shape, or else a mixed shape of said shapes. Accordingly, the pool according to the invention is not restricted to the classic internal-volume cuboidal shape of a swimming pool. The encircling boundary wall can assume a very wide variety of shapes, in the top view of the pool, and, in addition to or instead of rectilinear regions, can also have curved or arcuate regions. Of course, shapes can also be selected which interconnect both curved and also rectilinear regions. The baseplate is also not restricted to a flat design. Thus, for example, a plurality of baseplate parts arranged flat can be arranged in a step-shaped manner with respect to one another in a pool such that different internal volume depths can be provided in certain regions in the pool, for example depths which are suitable for children and depths which are conceived for adults. The baseplate can also be of inclined or curved design. In general, limits are scarcely placed on the shaping of the pool, and every pool shape that is hitherto already known can be produced by the pool according to the invention. The boundary wall per se also does not have to be of flat design, but rather can also have a curvature, steps or another shape differing from a flat shape in the vertical direction. The boundary wall can thus run, for example, at an inclination from the bottom upward, thus resulting in a conical shape of the internal volume of the pool.

According to a further embodiment of the present invention, it is provided that the treatment plant is arranged outside the boundary wall and the baseplate, wherein the inlet and the outlet are preferably attached in a watertight manner to cutouts in the boundary wall or in the baseplate. In this embodiment, the treatment plant is particularly easily accessible for maintenance work and is arranged outside the pool shell. The treatment element is connected to the internal volume by inlet and outlet being attached to cutouts in the boundary wall. Alternatively, it is also conceivable to connect inlet and outlet to the treatment element in a different way. For example, a collecting collar, described later in detail, can be provided as an inlet on the pool. Also, the outlet provided can be a different return of the cleaned water into the internal volume, for example in the form of a waterfall or the like, which opens into the internal volume. As an alternative thereto, the treatment plant can also be arranged inside the internal volume and delimited therein from the rest of the internal volume, for example, by further monolithic natural stones.

It can advantageously be provided that the integrally bonded connecting points between the individual monolithic natural stones of baseplate and/or boundary wall have similar strengths to, in particular the same strength as, the natural stone itself. This can be achieved in that an adhesive is selected as the integrally bonded connecting element, the adhesive, in the cured state, having similar strengths to, in particular the same strength as, the monolithic natural stones adhesively bonded therewith. The strength of the adhesive, for example the flexural strength or the compressive strength, in the cured state of the adhesive ought to be at least similar to the strength of the natural stones adhesively bonded therewith. The strength of the adhesive in the cured state can, however, also be less, for example half the strength of the monolithic natural stones, or a greater strength, for example four times the strength of the monolithic natural stones. Even with these strengths, a pool of the type described can be constructed and operated reliably over the long term. Strength should be understood here as meaning, for example, the maximum tensile, compressive or flexural stress that can be tolerated by the material. In particular, the flexural strength of the adhesive used in the cured state should be noted. This flexural strength ought to correspond, or at least be similar, to the previously mentioned ratios relating to the strength of the adhesive with regard to the strength of the natural stones. Owing to the fact that the connecting points and the natural stones advantageously provide the same or at least a similar strength, a composite arises which consistently has a homogeneous strength per se. Such a homogeneous strength over the entire pool shell inter alia facilitates a simple and reliable design calculation of the required wall thicknesses and the like. The use of an adhesive which is adapted to the anticipated use temperatures of the pool is also preferred. It has turned out that the use of an adhesive which is permanently stable up to a temperature of 60° C. ensures a connection that is stable over the long term between the individual monolithic natural stones.

According to a further preferred embodiment of the present invention, it is provided that the boundary wall has a wall thickness which corresponds to the root of the product of a design constant with the depth to the power of three, i.e. $depth^3$, wherein preferably the design constant is dependent on the maximum stress strength of the natural stone. In such an embodiment of the invention, the wall thickness of the boundary wall depends on the depth of the internal volume of the pool. In order to calculate the wall thickness, for this purpose, first of all a design constant with the depth of the internal volume of the pool is multiplied to the power of three. According to mathematical principles, the "$depth^3$" corresponds to the cube of the depth of the internal volume of the pool. During the continued calculation of the wall thickness, the square root is finally extracted from the product of the design constant with the $depth^3$, as a result of which the wall thickness of the boundary wall is obtained. The wall thickness calculated in this manner is a minimum wall thickness which is required for a permanent strength of the boundary walls against the water pressure from the internal volume. Of course, the boundary wall can also be dimensioned to be thicker than the calculated minimum value. In the case of the swimming pools known from the prior art, the static strength of the pool is provided via load-bearing partial or full substructures composed of known and standardized materials, such as concrete and steel, with natural stones merely being attached as a supplementary surface material without a static function. For the materials and designs known for such substructures, there have long been calculation bases which are partially also already incorporated into standards. By contrast, there is not a load-bearing substructure in the case of the pool according to the invention, as a result of which the strength of the pool according to the invention is provided solely by the boundary wall which is constructed from solid natural stones. For such a construction of a swimming pool, there are to date no fixed calculation bases for the design of pools, in particular swimming pools, which are composed purely of natural stone. It is merely known from the prior art to calculate the stresses which prevail in a boundary wall and which are produced by the water pressure in the internal volume. However, there are for this purpose no guide values whatsoever for the information as to the thickness of natural stone that has to be selected in order to compensate for said stresses reliably and in a stable manner over the long term. Thus, the prior art does not disclose any such pure natural stone pools which are suitable as swimming pools since the manufacturers of said pools of this order of magnitude have hitherto consistently resorted to the known "reliable" design with a substructure made from concrete or the like and natural stones applied thereto as surface elements. Hard rocks, for example granites, norites and gneisses, have turned out to be particularly suitable materials for a natural stone pool, with granite possibly being one of the preferred material options. Of course, a natural stone pool can also be constructed from other natural stones. The strength of the selected natural stones has to be taken into consideration for the configuration of the wall thickness.

Furthermore, it can be provided in the case of the present invention that a collecting collar is arranged in an encircling manner on the outer side of the boundary wall facing away from the internal volume, said collecting collar being provided to collect water escaping beyond the boundary wall from the internal volume during operation. The inlet of the treatment plant is preferably fluidically connected here to the collecting collar, and the collecting collar is furthermore preferably constructed from monolithic natural stones, wherein the connection of the monolithic natural stones of the collecting collar to one another and the connection of the collecting collar to the boundary wall are formed exclusively in an integrally bonded manner. According to an alternative embodiment thereto, a collecting collar can be provided which collects water escaping from the pool. Water escapes from the internal volume, for example, by the treatment plant pumping cleaned water into the internal volume. As a result, the pool overflows to a certain extent, and the excess water is collected by the collecting collar and supplied again to the treatment plant via the inlet thereof. The excess water can drain here directly over the upper edge of the boundary wall, over the entire extent thereof, and can flow directly over the outer edge of the boundary wall into the collecting collar. In such a configuration, where an overflow pool is also referred to, the overflowing water would then flow from the pool into the collecting collar, on into an overflow tank, then into the treatment plant and finally back into the pool. Alternatively, the excess water can also be guided specifically at certain points over or through the boundary wall. For example, at the upper edge of the boundary wall an overflow nose can be provided which constitutes the lowest point of the upper edge of the boundary wall and thereby transports the excess water in collected form out of the internal volume. Such an overflow nose is arranged here in such a manner that it is located above the collecting collar in a manner overlapping the latter. This ensures that the excess water is guided into the collecting collar, and the entire pool is watertight in relation to the surroundings. In a further alternative embodiment, an overlapping nose is arranged in an encircling manner on the boundary wall in a watertight manner with respect to the boundary wall. Such an overlapping nose extends outward from the boundary wall in the horizontal direction. Water which runs over the upper edge of the boundary wall continues to run downward on the boundary wall and finally comes upon the overlapping nose. The water flows outward along the overlapping nose and finally drips down from the lowermost region of the overlapping nose. The overlapping nose thus guides water which has escaped from the internal volume outward from the boundary wall. In this embodiment, a collecting apparatus which collects the water which has overflowed out of the internal volume can be arranged independently of the pool shell. For example, an overflow channel can be provided which is not connected to the pool. The overflow channel can thereby also be produced from different materials from the pool. In this embodiment, the overlapping nose is likewise constructed from monolithic natural stones and is connected per se and with respect to the boundary wall in a purely integrally bonded manner, in particular by adhesive bonded joints. The overlapping nose can also be composed of a different material, for example PE or steel. The overflow channel or other collecting apparatus arranged in the dripping direction below the overlapping nose can be designed in such a manner that it is not directly connected to the pool shell. An overlapping nose thus serves for guiding water which has escaped from the internal volume. Of course, such an overlapping nose can also be combined with an encircling collecting collar connected to the pool shell. The collecting collar can be constructed here in the same manner as the pool shell, namely from monolithic natural stones which are connected to one another and to the pool shell merely in an integrally bonded manner. As a result, the same advantages that were previously described for the pool shell emerge for the collecting collar. Since the collecting collar encircles the boundary wall, it may be that users wanting to reach the pool or exit from the latter enter the collecting collar. Since the collecting collar is likewise composed of a surface which is provided with good grip and has a pleasant feel, the pool user is provided with operational safety and a pleasant haptic feel simultaneously also in the region of the collecting collar.

It is preferably provided in the case of the present invention that the collecting collar comprises substantially horizontally arranged base parts and substantially vertically arranged wall parts, wherein the base parts and the wall parts together with the boundary wall can form a drainage channel. The inlet is fluidically attached here to a cutout in a base part, but can also be arranged in the boundary wall. In the case of such an embodiment of the pool according to the invention, the individual regions of the collecting collar together form a drainage channel which is provided to collect the water which has escaped from the internal volume and to supply same via an overflow tank to the inlet of the treatment plant. The drainage collar can be composed here of individual monolithic natural stones in an integrally bonded manner. As an alternative thereto, the drainage channel can also be formed from integral base parts, for example ground out of the latter. In addition, the drainage channel can be provided with a covering below which the removed water drains off. Such a covering can preferably likewise be composed of natural stone slabs with holes or openings arranged therein permitting the water to drain off.

According to a further preferred embodiment, it is provided that the pool has at least one separating point which separates the baseplate and the boundary wall into at least two pool parts. The at least two pool parts are interconnected at the separating point preferably by clamping devices, wherein furthermore preferably the pool parts are constructed per se from monolithic natural stones which are interconnected exclusively in an integrally bonded manner. In some cases, the pool cannot be transported integrally and set up at the destination location. A reason for this can be, for example, pool dimensions which are such a large size that they do not fit onto a transport vehicle. This is the case in particular if the pool has a free internal length or free length of greater than 10 m. However, a separating point in the pool may also be required even in the case of smaller dimensions, for example if little space is available at the set-up site or on the route thereto, and therefore only small parts can be transported to the set-up site. Furthermore, for the construction of the pool, sometimes only machines with a limited load-receiving capability are available, as a result of which division of the pool into a plurality of individual parts becomes necessary for weight reasons. Division of the pool into a plurality of individual parts can therefore be required for different reasons. In the case of the embodiment described here, the pool accordingly consists of a plurality of individual parts which are each constructed per se in accordance with one or more of the previously described embodiments and in particular do not have a load-bearing substructure. In the case of this embodiment, the pool is constructed modularly from a plurality of individual parts. Such a modular design is also particularly suitable if, for example, there is little space available at the installation site and therefore the use of large machines is not possible. In this case, the individual parts of the pool have to be positioned and constructed manually or using small and lightweight machines. It is particularly helpful here if the pool is composed of a plurality of smaller and lightweight individual parts. For example, it is also possible to construct a pool on the roof of a multi-story building. When a pool is erected at a great height, the modular design is also helpful since the individual parts can be transported substantially more easily to the construction site than a pool which is constructed from only one single part.

The individual parts are interconnected at a separating point between the individual parts preferably at the location at which the pool is set up. In order to connect the individual parts at the separating point thereof, clamping devices are preferably provided which, in the assembled state, connect the individual parts of the pool or of the pool shell in a force-fitting manner. However, said clamping devices act only on the respective separating point, but do not act on the connections of the individual monolithic natural stones in the individual parts to one another. It is preferably provided that a sealing means is inserted at the separating point, said sealing means being deformed by the clamping devices and sealing the at least two pool parts with respect to one another, wherein furthermore preferably the separating point also separates the collecting collar. In this embodiment, a sealing means which assists the watertightness between the individual parts of the pool shell can be provided at or in the separating point. Such a sealing means can be formed, for example, by what is referred to as a sealing cord which is inserted into the separating point. In order to receive such a sealing cord, grooves can be provided at the boundary surfaces of the individual parts, the grooves receiving a certain portion of the sealing cord, with the remaining portion of the sealing cord protruding outward beyond the grooves and the boundary surface. The sealing cord is guided by means of such grooves during the clamping of the individual parts, and therefore said sealing cord cannot inadvertently slip between the components to be connected. In addition, the groove enables the visible joint to be of a small size. Alternatively, other sealing means can also be used, for example sealing pastes or else adhesives, as are used for connecting the individual monolithic natural stones to one another.

According to a preferred embodiment, it can furthermore be provided that the monolithic natural stones of the baseplate and of the boundary wall are composed of granite, wherein preferably all the monolithic natural stones installed in the pool are composed of the same type of granite or of different types of granite. Granite has turned out to be particularly suitable for the construction of a pool since it has, inter alia, high strength and hardness, can readily be machined and is available in different colors or color shades. The pool according to the invention can be composed exclusively of a single type of granite, as a result of which it obtains a uniform appearance. Alternatively thereto, it is also conceivable for various different types of granite to be able to be used for a pool. For example, natural stones having a darker color shade can be used for the pool shell and granite stones having a lighter color shade can be used for the encircling collecting collar. Of course, other possibilities of a non-uniform coloring are also conceivable. For example, even for the pool shell, lighter and darker monolithic natural stones could be arranged in an alternating manner next to one another, as a result of which a desired pattern can be set. According to a furthermore preferred embodiment of the present invention, it can be provided that the surfaces of the monolithic natural stones formed from granite are surface-treated. By means of such a surface treatment, the properties thereof can be influenced. For example, varnishing or impregnation can be undertaken in order to provide the natural stone with a different appearance. It is also conceivable to undertake an impregnation in order to further improve the resistance of the surface to chemicals in the water.

In a further embodiment of the pool according to the invention, a pool base is provided which is arranged below the baseplate and comprises a plurality of bearing pedestals, wherein the bearing pedestals are arranged spaced apart from one another, and the baseplate rests in some regions on the bearing pedestals. In this embodiment, the pool is arranged on a pool base which is located below the baseplate. Said pool base serves for dissipating the weight forces, which arise from the water located in the internal volume and the dead weight of the pool shell, into the underlying surface. The pool base here comprises a plurality of bearing pedestals which are arranged spaced apart from one another, in particular at regular distances from one another. The bearing pedestals can be anchored here either in each case individually in the underlying surface or on a common element. The baseplate of the pool does not rest here over the full surface area on the bearing pedestals, but rather only in some regions. Cavities in which the baseplate extends without support are provided between the bearing pedestals. In said cavity regions, the baseplate is subjected to a bending load by the weight and the pressure of the water located in the pool and absorbs flexural stresses acting on it by itself, i.e. without additional assisting or supporting structures.

It is optionally provided in the case of the pool according to the invention that the pool base also has a concrete slab on which the bearing pedestals are positioned spaced apart from one another. In this embodiment, the pool base comprises a horizontally oriented concrete slab on which a plurality of bearing pedestals are arranged. By means of the provision of such a concrete slab, the horizontal orientation of the entire pool can be realized more simply than is the case with individually anchored bearing pedestals.

In a further embodiment, a surrounding element is provided which at least partially encircles the boundary wall, wherein the surrounding element is in contact by at least one spacer structure with the boundary wall, and is connected fixedly or via friction thereto. This means that the surrounding element lies by at least one spacer structure against the boundary wall and accordingly can absorb compressive forces, but does not necessarily have to absorb tensile forces. The pool here correspondingly comprises at least one surrounding element which serves to connect the pool to its horizontally encircling surroundings. For example, a tread surface, for example made from natural stones, tiles or the like, which can serve as a path or access to the pool, can be applied to the surrounding element. Alternatively thereto, earth or humus can be applied to the surrounding element such that planting of the surrounding region around the pool as far as the boundary wall is possible. The surrounding element can thus serve as a supporting element for various configurations with which the surroundings of the pool outside the pool shell can be configured. One embodiment here is to arrange the surrounding element around the entire circumference of the boundary wall on the side of the boundary wall facing away from the internal volume. Alternatively thereto, the surrounding element can also extend only along part of the circumference of the pool. The surrounding element is preferably arranged around the boundary wall with a gap as spacer therefrom. The surrounding element is fastened to the pool, for example, by at least one spacer structure which serves as a means for fixing the orientation or position between surrounding element and boundary wall. In the event that the surrounding element encircles a larger part of the boundary wall or else the entire boundary wall, a plurality of spacer structures which are arranged spaced apart from one another can be provided.

As a further option, it can be provided in the case of the pool according to the invention that the abovementioned spacer structure is connected to the boundary wall via an in particular circular contact element which can transmit forces between the boundary wall and the surrounding element, wherein such a contact element can be located in the upper half of the boundary wall, in particular in the upper third of the boundary wall. In this embodiment, connection and transmission of force between the surrounding element and the boundary wall takes place via such a contact element of the spacer structure. The contact element is expediently of circular design and lies only in a limited region against the boundary wall. A transmission of force between surrounding element and boundary wall thus takes place only in the region of the supporting surface between contact element and boundary wall. Owing to the fact that the surrounding element is conventionally arranged in the vicinity of the upper edge of the boundary wall, the spacer structure is also arranged with the contact element in the upper half of the boundary wall, in particular in the upper third of the boundary wall. A transmission of force between boundary wall and surrounding element thus takes place only in said upper region of the boundary wall. In the lower half of the boundary wall, there is correspondingly conventionally no transmission of force between surrounding element and boundary wall.

In a further embodiment of the pool according to the invention, it is provided that the monolithic natural stones which form the baseplate and the boundary wall together with the integrally bonded connection between the monolithic natural stones absorb at least a portion of the forces arising due to the flexural stresses, wherein the flexural stresses are produced in the baseplate and in the boundary wall because of the pressure generated by the water located in the internal volume during operation of the pool. The natural stones which form the pool shell consisting of baseplate and boundary wall are subjected to a bending load by means of the water pressure. In contrast to the prior art, an extensive substructure which rests on the entire outer surface of the pool shell and absorbs the forces resulting from the water pressure is not provided here. The pool shell per se absorbs at least a large portion of the forces which are generated by the water located in the internal volume. When a surrounding element as described previously that is connected to the boundary wall via at least one spacer structure is used, it is possible for a portion of the forces resulting from the water pressure in the interior of the pool to be able to be absorbed by said surrounding element. In this case, however, flexural stresses arise in the natural stones, the flexural stresses resulting from the water pressure in the interior of the pool and being able to be absorbed solely by the natural stones. The surrounding element can reduce said flexural stresses in the natural stones by absorbing the compressive forces acting on the natural stones and thereby relieving the natural stones of load.

As a further option, it can be provided in the case of the pool according to the invention that the pool base and/or the surrounding element in combination with at least one spacer structure absorb a portion of the flexural stresses which arise in the baseplate and in the boundary wall due to the pressure generated because of the water located in the internal volume during operation of the pool, wherein the baseplate and the boundary wall absorb another portion of said flexural stresses. The pool base and/or the surrounding element reduce the flexural stresses in the natural stones by being able to absorb and dissipate the compressive forces acting on the natural stones, as a result of which the natural stones are relieved of load. In this embodiment, a portion of the forces and loads generated by the water in the interior of the pool shell is accordingly damped by the pool base and/or the surrounding element connected to the pool shell. By connecting these elements to the pool shell, the pool shell is supported or relieved of load in some regions, as a result of which the flexural stresses in the natural stones of the pool shell can be reduced.

The object of the present invention is furthermore achieved by the use of a self-supporting pool shell as a pool for receiving one or more people for carrying out sports or relaxation activities. The pool shell is formed here by a baseplate and a boundary wall, wherein the baseplate and the boundary wall are each constructed from at least one monolithic natural stone, and the monolithic natural stones are interconnected in a watertight manner exclusively by an integrally bonded connection. According to the invention, a pool which is constructed exclusively from natural stones which are interconnected in an integrally bonded manner is used as a pool or swimming pool. A treatment plant for the water located in the pool can additionally be provided here. It is preferably provided that the self-supporting pool shell is divided per se by at least one separating point, and the at least two parts of the pool shell can be transported separately from one another to the construction site and are interconnectable in a watertight manner at the construction site, as a result of which a pool is produced at the construction site, preferably a pool according to the present invention as described previously. In this embodiment of the use according to the invention, a multi-part pool is connected from individual parts at the construction site and subsequently used as a swimming pool. The individual parts here each correspond per se to one or more of the previously mentioned embodiments of the pool according to the invention, with the associated advantages of the present invention.

The object of the invention is finally furthermore achieved by a method for producing a pool, in particular according to one of the previously described embodiments, wherein the method according to the invention comprises the following steps, preferably precisely in the indicated sequence:

(a) constructing a baseplate, wherein the baseplate is composed of a plurality of monolithic natural stones, and the connection between the monolithic natural stones of the baseplate takes place in a purely integrally bonded manner;

(b) introducing cutouts into a boundary wall and/or into the baseplate, wherein the cutouts are provided for the connection of a treatment plant;

(c) constructing the boundary wall at the edge of the baseplate, wherein the boundary wall extends vertically upward from the baseplate, and the boundary wall is closed per se and, together with the baseplate, surrounds an internal volume in a watertight manner which can be filled with water during operation of the pool. The boundary wall is composed of a plurality of monolithic natural stones, and the connection between the monolithic natural stones of the boundary wall and of the baseplate takes place in a purely integrally bonded manner; and (d) attaching the treatment plant, which comprises an inlet connected to the internal volume, an outlet connected to the internal volume, and a treatment element arranged in the flow direction of the water between inlet and outlet, wherein the inlet and the outlet are attached to the cutouts in a watertight manner.

The method according to the invention serves in particular to construct a pool according to one of the previously described embodiments. For this purpose, first of all a baseplate is assembled from individual, monolithic natural stones. No supporting structure made from concrete or the like is required below said baseplate. Of course, the pool can also be constructed on a substructure, such as, for example, a concrete slab, which facilitates the alignment of the pool, for example with respect to the horizontal. However, such a substructure is not absolutely necessary. The baseplate can be applied directly to a rolled underlying surface consisting of gravel or sand. Subsequently, in the next step, a boundary wall is connected to the baseplate. The boundary wall can be placed here onto the baseplate or can be connected laterally thereto. Baseplate, boundary wall and the connecting points between the two are designed to be exclusively integrally bonded. No further connecting elements of other materials are used. The connecting points between the individual monolithic natural stones serve firstly for the mechanical connection and secondly for sealing the pool shell formed from baseplate and boundary wall. After the pool shell is constructed, cutouts are introduced, if required, into the pool shell, the cutouts serving for receiving installations for the pool. Finally, a treatment plant is connected to the pool shell in order to be able to clean the water located therein during operation of the pool. With the method according to the invention, a robust natural stone surface swimming pool which is stable over the long term and has a simplified overall structure can be provided, the swimming pool therefore providing a solution for the known problems, as described further above, and effectively avoiding the disadvantages of the prior art.

A pool which can be transported integrally, that is to say without separating points, to the set-up site is conventionally entirely produced in a production factory. The baseplate is connected in an integrally bonded manner, in particular adhesively bonded, to the boundary wall there, and therefore the pool shell is completely constructed. Adhesive bonding at the set-up site is conventionally not provided. The final method step for the production of the pool, the connection of the treatment plant, conventionally takes place in situ at the set-up site of the pool. In the case of pools which have one or more separating points, conventionally also all the integrally bonded connections, in particular adhesive bonds, are undertaken in a production factory. Thus, also here, the individual parts or modules of the pool, to the extent possible, are ready prepared at the factory, and therefore only connection of the individual parts or modules at the separating points is required at the set-up site in order to complete the pool shell. The individual parts or modules can comprise both parts of the baseplate and parts of the boundary wall. The separating points which are provided thus run through baseplate and boundary wall. Adhesive bonding of the monolithic natural stones of the pool shell, i.e. within the baseplate, within the boundary wall and at the connecting points between baseplate and boundary wall, can be carried out in a very stable process under constant boundary conditions in a production factory. In particular, constant climatic conditions and the required extent of purity are available in a production factory. However, it is also possible to undertake adhesive bonds at the set-up site. A disadvantage of adhesive bonding at the set-up site can be, however, unsuitable boundary conditions for the adhesive bonding process, for example moisture or dirt.

Features which have previously been described for one embodiment of the pool can also be accordingly used for the definition of the use according to the invention and for the definition of the method according to the invention and are hereby expressively also disclosed as use and/or method features. The same applies the other way round; features which are disclosed only for the use or for the method can also be used for the definition of the pool according to the invention.

As possibly used here and also in the attached claims, the singular forms "a"/"an" and "the" may also comprise the plural thereof unless the context unambiguously predefines something else. In a similar manner, the words "comprise", "contain" and "have" should be understood as meaning both "exclusively" and also "not exclusively", i.e. within the meaning of "including, but not restricted to . . . ". The terms "a plurality of", "multiple" or "a multiplicity" conventionally relate to two or more, i.e. 2 or >2, including further integral multiples of 1, wherein the terms "individually" or "solely" relate to one (1), i.e. "=1". Furthermore, the expression "at least one" should be understood as meaning one or more, i.e. 1 or >1, likewise with integral multiples. In addition, the words "herein", "above", "previously" and "below" or "subsequently" and words with a similar meaning, if used in this description, are intended to relate to this description as a whole and not to certain parts of the description.

The description of specific embodiments in this document is not intended to be considered as exhaustive, or the disclosure provided herein is not intended to be restricted to the precise disclosed form. While specific embodiments and examples for the disclosure that are described herein serve for illustrative purposes, various equivalent modifications are possible within the scope of protection of the disclosure, as can be seen by a person skilled in the art in the present technical field. Specific technical elements of described embodiments can be combined with technical elements in other embodiments or be replaced by same. In the drawings, identical reference numbers refer to identical elements, in order to avoid repetitions, and parts which can be realized by a person skilled in the art without special knowledge may be omitted for reasons of clarity. While advantages which are assigned to certain embodiments of the disclosure are described in conjunction with these embodiments, other embodiments may likewise have these advantages.

The embodiments below are intended to illustrate various possible modifications of the present invention. As such, all specific technical details, as are likewise discussed below, should not be interpreted as restrictions of the scope of the present invention. It is obvious to a person skilled in the art that various modifications and amendments can be undertaken without deviating from the scope of protection of the present application as defined by the appended claims. Further aspects and advantages of the present invention emerge from the following description of the preferred embodiments which are illustrated in the figures.

PREFERRED EMBODIMENTS OF THE INVENTION

Figure 1:
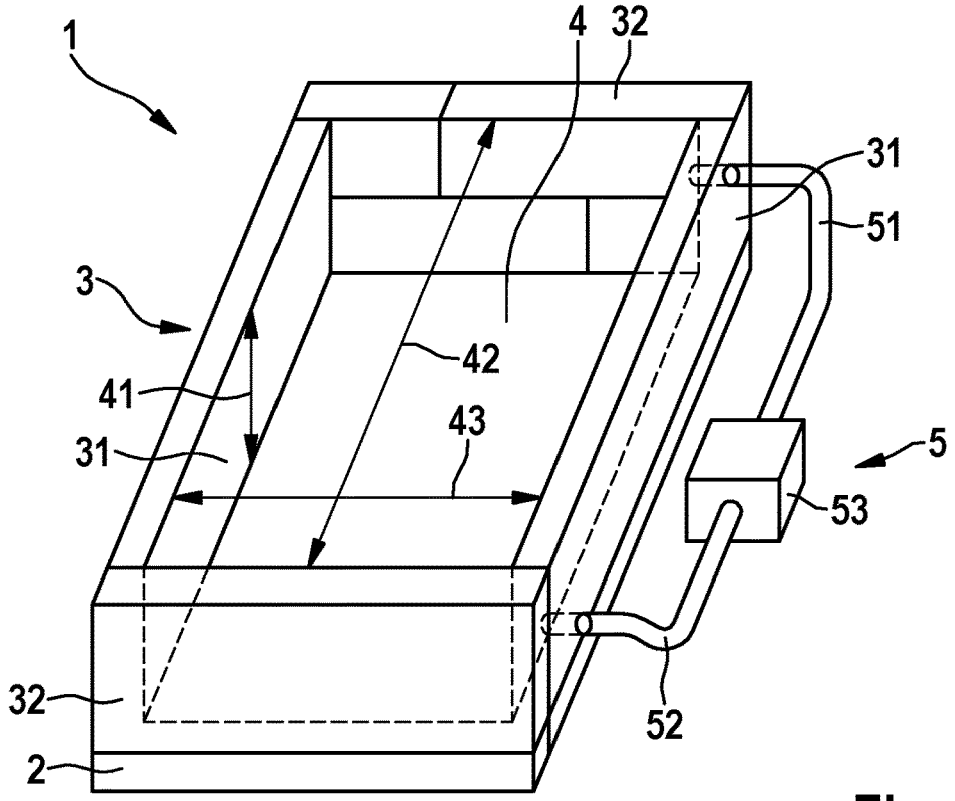
FIG. 1 shows a perspective view of a preferred embodiment of a pool according to the invention.

In the following description of the preferred embodiments of the present invention, the figures illustrate the subject matter of the invention merely schematically. The preferred embodiments of the invention are illustrated in the drawings and will be described in more detail below.

FIG. 1 shows a perspective view of a preferred embodiment of a pool 1 according to the invention. The first embodiment illustrated has a rectangular basic shape. The base of the pool 1 forms the baseplate 2. Said baseplate 2 is formed here from a single monolithic natural stone. The term "monolithic" should be understood here as meaning that the baseplate 2 consists of a single part and is not constructed per se from a plurality of individual parts. Such monolithic natural stones are conventionally extracted from a quarry in larger volume than their final form and subsequently machined to the desired dimensions. A boundary wall 3 is constructed along the baseplate 2. The boundary wall 3 encircles and delimits an internal volume 4 of the pool 1, which is bounded on its lower side by the baseplate 2. During operation of the pool 1, the internal volume 4 can be filled with water up to the upper edge of the boundary wall 3. The boundary wall 3 here comprises two sidewalls 31 running from the front to the rear, i.e. along the swimming pool 1, also called longitudinal sidewalls 31, and two sidewalls 32 running from right to left, i.e. across the width of the pool 1, also called wide sidewalls 32.

The individual parts of the boundary wall 3 are interconnected in an integrally bonded manner. In the embodiment illustrated, the connection of the individual parts is produced exclusively by adhesive bonding. The connection of the boundary wall 3 to the baseplate 2 is also produced exclusively by adhesive bonding. No further connecting elements, such as, for example, screws or clamps, are installed. Except for the adhesive bonding points, the boundary wall 3 is also composed exclusively of natural stone. The entire pool shell of the pool 1 formed from baseplate 2 and boundary wall 3 is thus composed exclusively of natural stone and adhesive bonding points. The adhesive used and the natural stone are chemically resistant over the very long term to water, even to chlorinated water. Metallic connecting elements are not used, and therefore the entire pool shell is highly resistant to corrosion over the long term. In the embodiment illustrated, the front wide sidewall 32 and the two longitudinal sidewalls 31 are each formed from a single monolithic natural stone. By contrast, the rear wide sidewall 32 is assembled from a plurality of monolithic natural stones. These individual parts of the rear wide sidewall 32, like the other parts of the pool shell of the pool 1, are exclusively adhesively bonded to one another, i.e. no additional connecting elements are used here either. A construction such as of the rear wide sidewall 32 from a plurality of natural stones is selected in particular in the event of the pool 1 being of larger dimensions since the maximum size of an individual natural stone is limited, for example, by the requirement of transport from the quarry to the stone-machining workshop or to the swimming pool production site. According to the invention, the individual parts of the pool 1 are interconnected via an adhesive bonded joint which has the same mechanical strength as the natural stone itself. In specific applications, it is, of course, possible to arrange form-fitting or force-fitting connecting elements in addition to the adhesive bonded joint between the individual monolithic natural stones of the pool. In some applications, for example when a pool is erected on a multistory building, there may be more stringent safety regulations for the construction of the pool. In such a case, of course, the previously described additional connecting elements, such as, for example, compound anchors, may be introduced for the additional prescribed protection of the connection of the individual parts of boundary wall 3 and baseplate 2.

In the case of the pool 1 according to the invention, there is no load-bearing substructure composed of different materials from natural stone. The elements constructed in solid form from natural stone in the form of the baseplate 2 and boundary wall 3 by themselves provide the strength required for absorbing the water pressure. A pool 1 according to the invention is therefore constructed in a self-supporting manner purely from natural stone. Of course, a pool according to the invention can also be provided on a substructure, for example a concrete slab. However, such a substructure is not required for achieving permanent static strength. Natural stone, in particular granite, is stable over the very long term, and is significantly more stable over the long term than conventional substructures made from concrete. The solid design from natural stone also makes it possible for water not to be able to penetrate between individual layers, for example between substructure and visible surface. A pool according to the invention because of the high-quality material is thus significantly more durable than known swimming pools or pools. In comparison to pools according to the prior art, in which first of all a substructure is produced and then the natural stone surface is applied to said substructure, the pool 1 according to the invention can be produced in a significantly reduced number of working steps. Furthermore, the pool 1 according to the invention has a natural stone surface everywhere, i.e. for example even on its outer side. The pool 1 according to the invention is thus composed virtually exclusively of very high-quality materials, i.e. produces a very high-quality impression for a user, and provides a surface with optimal grip everywhere. The design described in the present invention makes it possible to configure the boundary wall 3 of the pool 1 to be slender throughout, and therefore significantly more slender than in the case of a multi-layered construction of a known swimming pool/pool with a substructure made from concrete and a visible surface of natural stone applied subsequently.

The internal volume 4 in the embodiment illustrated of the pool 1 according to the invention is cuboidal. The internal volume 4 has a depth 41 which is greater than 0.5. A further favorable depth 41 is a depth which is greater than 1 m. A free length 42 of the internal volume 4 is greater than 2 m and a free width 43 of the internal volume 4 is greater than 2 m. By means of these preferred dimensions, the water located in the internal volume 4 can be used for swimming or for other sports or relaxation activities by a user. A treatment plant 5 can be seen in FIG. 1 on the right-hand side next to the right longitudinal sidewall 31. The treatment plant 5 comprises an inlet 51 via which water located in the internal volume 4 is supplied through a cutout at the rear in the longitudinal sidewall 31 to a treatment element 53. The treatment element 53 typically comprises a pump for transporting the water and a filter which filters suspended matter and dirt out of the transported water. After the treatment element 53, the treated water passes back again via an outlet 52 into the internal volume 4, in the case illustrated via a cutout in the lower half at the front on the right longitudinal sidewall 31. In addition to the treatment element 53, the treatment plant 5 can comprise further components, such as, for example, a disinfection plant and/or flocculation plant.

Figure 2:
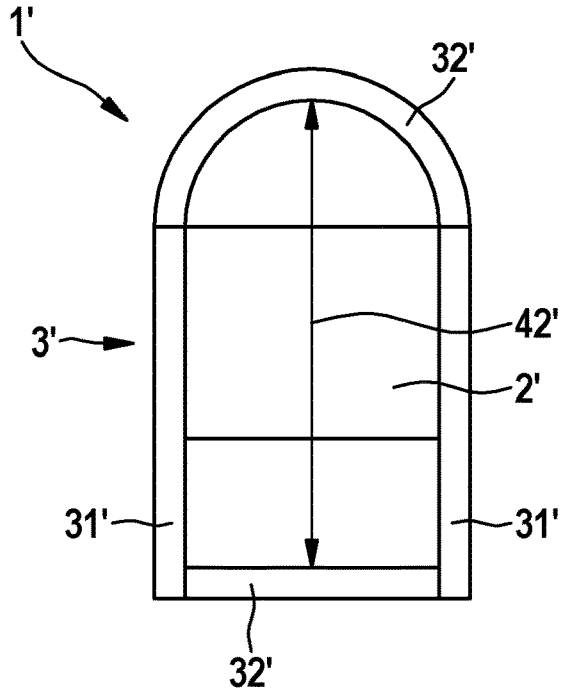
FIG. 2 shows a second preferred embodiment of a pool according to the invention in a top view.

FIG. 2 shows a top view of a further, second preferred embodiment of a pool 1'. In contrast to the first preferred embodiment shown in FIG. 1, the boundary wall 3' of the second embodiment shown in FIG. 2 does not have a rectangular shape in top view. Only that region of the boundary wall 3' which is oriented downward in FIG. 2 is constructed from flat walls in the form of the lower wide sidewall 32' and the longitudinal sidewalls 31'. In the top view illustrated in FIG. 2, the upper wide sidewall 32' has the shape of half a circular ring or approximately the shape of an upside down "U". The free length 42' of the internal volume 4' here is the greatest length dimension of the internal volume 4' which extends between the lower flat wide sidewall 32' and the point which is furthest away therefrom and, in the view shown in FIG. 2, is entirely at the top of the circular ring of the upper wide sidewall 32', the apex point of the curve of the upper wide sidewall 32'. The pool 1' according to the invention can have a very wide variety of shapes in top view. The shape illustrated in FIG. 2 is a mixed shape consisting of rectilinear and curved walls. Of course, boundary walls can also be configured with other shapes in top view, for example a shape purely in the form of a circular ring or a polygonal shape. The free length and free width here are always defined as the maximum dimensions of an internal volume of the pool shell in the respective direction. In the embodiment of the pool 1' which is illustrated in FIG. 2, the baseplate 2' is assembled from a total of three monolithic natural stones, wherein the connecting points formed by an adhesive bond run horizontally in FIG. 2. FIG. 2 shows merely a simplified illustration of the pool 1', in which a treatment plant is not illustrated for reasons of clarity.

Figure 3:
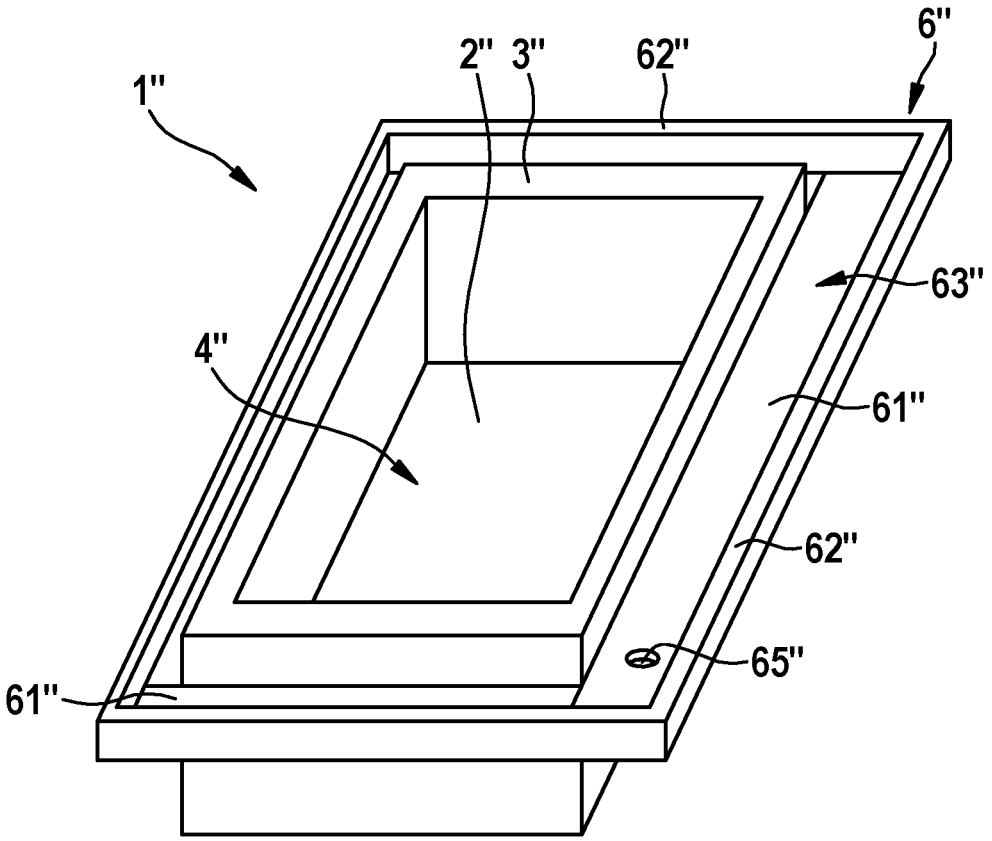
FIG. 3 shows a perspective view of a third preferred embodiment of a pool according to the invention.

FIG. 3 shows a perspective view of a third preferred embodiment of a pool 1". The embodiment illustrated here, like the embodiment of the pool 1 in FIG. 1, comprises a pool shell which is formed from a baseplate 2" and a boundary wall 3". The baseplate 2" and the boundary wall 3" also surround an internal volume 4" here. As already described with reference to the embodiment illustrated in FIG. 1, baseplate 2" and boundary wall 3" are assembled in solid form from monolithic natural stones which are interconnected exclusively in an integrally bonded manner. The preferred embodiment illustrated in FIG. 3 also comprises a treatment plant which, however, is not illustrated here for reasons of clarity, and which continuously pumps the water in the internal volume 4 through the treatment element where the water is cleaned. After cleaning, the water is supplied again to the internal volume 4". In the embodiment illustrated in FIG. 3, water runs down over the upper edges of the boundary wall 3" and is collected by the collecting collar 6" arranged in an encircling manner on the outer side of the boundary wall 3", thus giving the impression of an "infinity pool". For users who are in the pool 1", the impression is accordingly produced that they are in a free water area since the pool 1" does not have any components which protrude beyond the water surface. From the collecting collar 6", the water then passes through a cutout 65" to the inlet (not illustrated) of the treatment plant. At the same time, the collecting collar 6" serves to receive water which is displaced, for example, by people jumping into the pool 1". The collecting collar 6" is preferably likewise constructed from monolithic natural stones. The collecting collar 6" here comprises a plurality of base parts 61" which are designed here as slabs oriented substantially horizontally. At its outer edge, the collecting collar 6" is surrounded by a plurality of vertically oriented wall parts 62". The wall parts 62", the base parts 61" and the regions of the outer side of the boundary wall 3" that are arranged adjacent to the base parts 61" together form a drainage channel 63" in which water which has escaped from the internal volume 4" is collected and supplied to the cutout 65". The inlet of the treatment plant is subsequently fluidically attached to said cutout 65". The individual parts of the collecting collar 6" are constructed solidly from monolithic natural stones and adhesively bonded to one another and to the boundary wall 3" without additional fastening elements being used. A particularly suitable natural stone material for the embodiments shown and described herein is granite since granite has high strength and its surface, in particular its roughness, can be particularly readily adjusted to the requirements.

Figure 4:
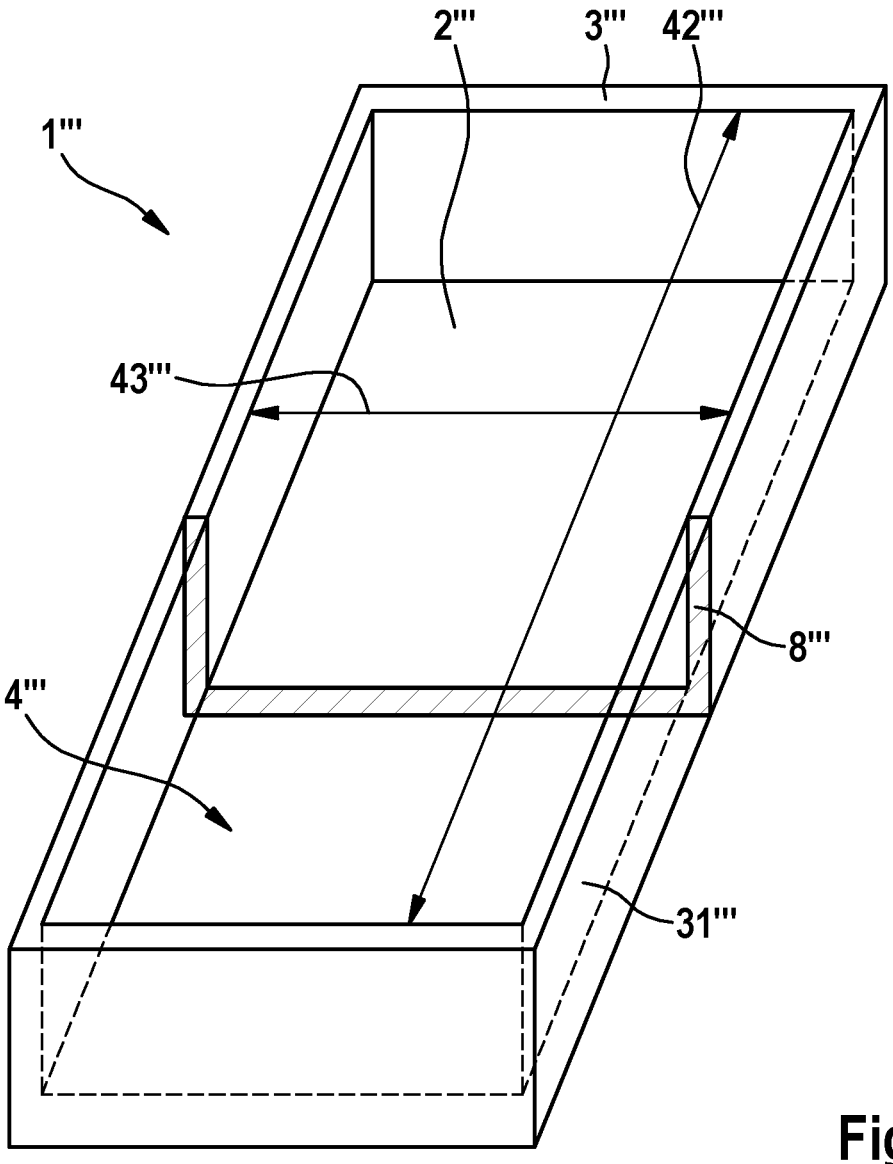
FIG. 4 shows a perspective view of a fourth embodiment of a pool according to the invention.

FIG. 4 shows a perspective view of a fourth preferred embodiment of a pool 1'". The embodiment shown in FIG. 4 has a significantly longer free length 42'" than the preferred embodiments shown in FIGS. 1 and 4. This free length 42'" is provided here with a size greater than 10 m. Such long pools 1'" cannot be transported completely in one piece to the set-up site, as a result of which it is necessary to divide the pool 1''', in particular the pool shell, which is formed from baseplate 2''' and boundary wall 3''', and to transport the pool parts individually to the set-up site. The parts are interconnected only at the set-up site. In the preferred embodiment illustrated of the pool 1''', there is a separating point 8''' which divides the pool shell into two pool parts. In the case of pools having even greater dimensions, there can also be a plurality of separating points 8''' which divide the pool shell into a plurality of parts. Furthermore, it is possible, in addition to the separating point 8''' which is shown in FIG. 4 and is arranged along the free length 42''', also to arrange one or more separating points 8''' along the free width 43'''. At the separating point 8''', the two pool parts are interconnected in a fixed and watertight manner. FIG. 4 again illustrates the pool 1''' with a simplified design, i.e. the treatment plant is not shown for reasons of clarity. One or more separating points can also be provided in the case of the embodiment according to FIG. 3. In this case, the optional separating point also passes through the collecting collar 6". In general, of course, pool shells having a different geometry of the internal volume, i.e., for example, as illustrated in FIG. 2, can be divided into a plurality of pool parts and interconnected at separating points.

Figure 5:
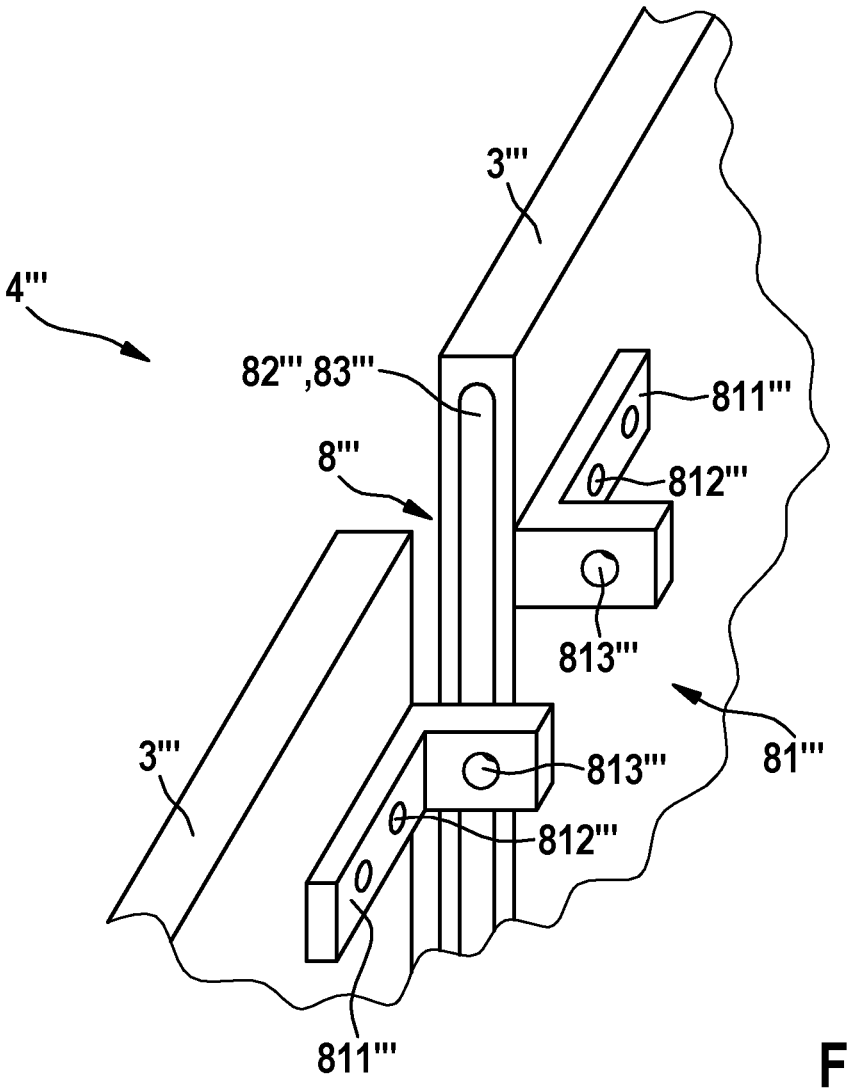
FIG. 5 shows a perspective view of a detail before connection of two pool parts of the pool according to the invention from FIG. 4.

Details regarding the arrangement of the separating point 8''' and the two pool parts are illustrated in FIG. 5. FIG. 5 here shows a perspective view of a detail before the connection of two pool parts of the pool 1''' from FIG. 4. FIG. 5 shows in particular the state before the connection of the two pool parts via a separating point 8'''. Only one part of the pool 1''' in the region of the right longitudinal sidewall 31''' shown in FIG. 4 is illustrated. In FIG. 5, two parts of the boundary wall 3''' are correspondingly illustrated still separately from each other. The separating point 8''' is located between these two parts of the boundary wall 3'''. A clamping device 81''' can be seen on that side of the boundary wall 3''' which faces away from the internal volume 4'''. Said clamping device 81''' has two angular elements 811''' of which one is fastened to each of the parts of the boundary wall 3'''. The angular elements 811''' can be connected in an integrally bonded manner and/or via additional connecting elements. In the case illustrated, one or more fastening openings 812''', through which the angular element 811''' can be additionally connected to the boundary wall 3''', for example via screw connections, are arranged in each angular element 811'''. The angular element 811''' is correspondingly connected to the boundary wall 3''' via one of its two limbs. At a right angle to said boundary wall limb, a further limb is arranged which serves to connect the two angular elements 811''' to each other. Said further limb protrudes in a manner pointing away from the boundary wall 3" and provides a bore 813". In order to interconnect the pool parts, a tensioning means, not illustrated here, is guided through the respective bores 813''' of the angular elements 811''' and serves to connect the two angular elements 811''' to one another under tension, as a result of which the two pool parts are fixedly interconnected at the separating point 8'''. Such a tensioning means can be, for example, a threaded bolt which is tensioned on one side by a nut. In order to seal the two pool parts with respect to each other a sealing means 82''' is inserted at the separating point 8'''. In the case illustrated, the sealing means 82''' is a sealing cord or the like. In order to receive the sealing cord 82''', a groove 83''' has been introduced on the rear part of the boundary wall 3''', on the end side thereof facing the separating point 8'''. Said groove 83''' receives at least part of the sealing cord 82''' and thus facilitates the fastening thereof. At the rear part of the boundary wall 3''', during the tensioning of the two pool parts by the tensioning device 81''', the sealing means 82''' is deformed and thus seals the separating point 8''' in a watertight manner. Of course, the sealing can also take place via different sealing means than a sealing cord, for example via a sealing coating or an adhesive bonded joint, as is also used for connecting the monolithic natural stones to one another. In order to connect the two pool parts, a plurality of tensioning devices 81''' which are arranged along the separating point a" are conventionally provided. For this purpose, tensioning devices 81''' can also be arranged at the bottom of the pool shell, in a manner fastened to the baseplate 2'''.

Figure 6:
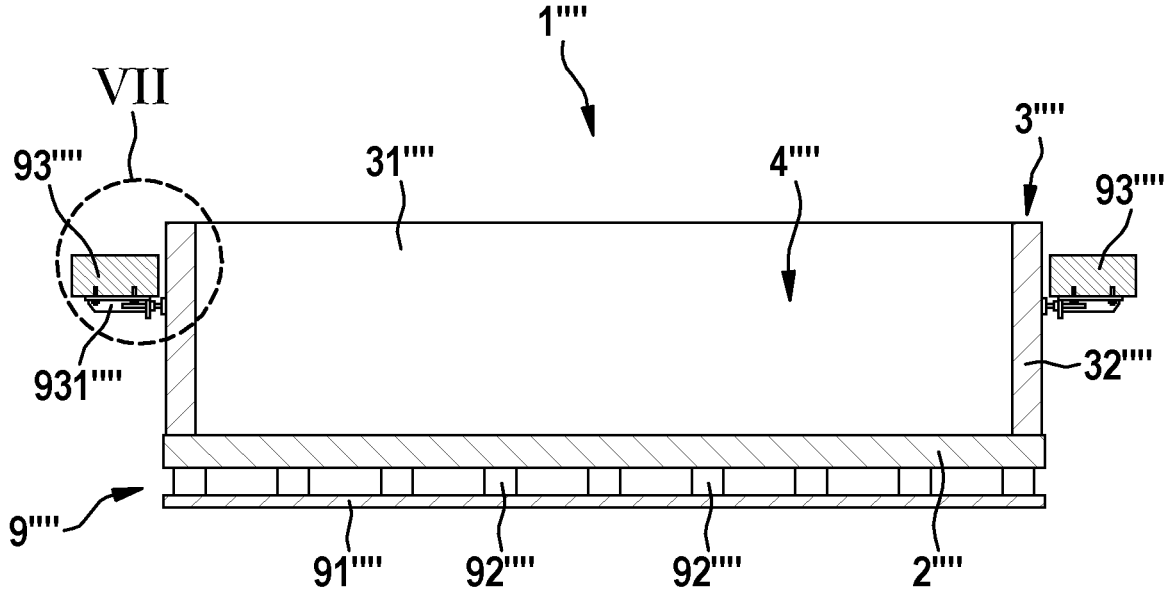
FIG. 6 shows a sectioned side view of a fifth embodiment of a pool according to the invention.

FIG. 6 shows a sectioned side view of a fifth embodiment of a pool 1'''' according to the invention. The embodiment shown in FIG. 6 is similar to the embodiment shown in FIG. 1. A cuboidal pool 1'''' with a baseplate 2'''' and a boundary wall 3'''' is illustrated. The baseplate 2'''' and the boundary wall 3'''' together form the pool shell which surrounds an internal volume 4'''' which can be filled with water up to the upper boundary of the boundary wall 3''''. The entire pool shell is also constructed here from monolithic natural stones which are interconnected in an integrally bonded manner. The pool 1'''' again comprises a treatment plant 5 which, however, is not illustrated in FIG. 6 for reasons of clarity. The pool 1'''' has longitudinal sidewalls 31'''' of which only the rear longitudinal sidewall 31'''' can be seen in the sectioned illustration. The two longitudinal sidewalls 31'''' are connected at the ends thereof to two wide sidewalls 32''''. The two wide sidewalls 32'''' are illustrated in sectioned form in FIG. 6. The pool 1'''' rests here on a pool base 9'''' which comprises a concrete slab 91'''' and a plurality of bearing pedestals 92''''. The fifth embodiment of the pool 1'''' according to the invention that is illustrated in FIG. 6 can be used both in a freestanding manner and embedded in the ground or in the soil as a swimming pool. The pool base 9'''' serves primarily for horizontally aligning the pool 1''''. The concrete slab 91'''' here forms the lowermost layer of the pool base 9''''. The concrete slab 91'''' can be produced, for example, on a rolled underlying surface by a casting method or the like. In the embodiment illustrated in FIG. 6, the baseplate 2'''' of the pool does not rest directly on the concrete slab 91'''', but rather is mounted on a plurality of bearing pedestals 92'''' which are applied to the concrete slab 91''''. The bearing pedestals 92'''' are formed here by cylindrical regions which can be formed, for example, from construction mortar. The bearing pedestals 92'''' can also be designed with a longer extent in the vertical direction and can be formed, for example, by foundation pillars which are applied to the concrete slab 91''''. The baseplate 2'''' of the pool 1'''' rests on a plurality of bearing pedestals 92'''', as a result of which the weight force which is produced by the pool 1'''' and the water located in the internal volume 4'''' can be dissipated into the underlying surface. The pool base 9'''', in particular the bearing pedestals 92'''', are therefore loaded by compressive stress resulting from the weight force of the pool 1''''. The bending stresses, which are produced by the water in the internal volume 4'''', in the pool shell, in particular in the baseplate 2'''', are completely or at least largely compensated for by the pool shell itself. Bending stresses in the baseplate 2'''' occur in particular in the regions which do not rest directly on the bearing pedestals 92''''. Of course, bending stresses also occur in the natural stone at the locations of the supporting points on the bearing pedestals 92'''' since the bending stress profile produced by the water follows the pattern of a continuous support, i.e. flexural stresses occur between the supporting points on the bearing pedestals 92"" on a lower side and in the region of the supporting points on the bearing pedestals 92"" on an upper side. A distance between two adjacent bearing pedestals 92"" here determines the magnitude of the bending stresses occurring in the baseplate 2"". The following is true here: the greater the distance between two adjacent bearing pedestals 92"", the greater are the bending stresses occurring in the baseplate 2"". In practice, the distance between two adjacent bearing pedestals 92"" is selected in such a manner that the bending stresses occurring between the bearing pedestals 92"" are lower than the flexural strength of the baseplate 2"" which is constructed from monolithic natural stones. In an alternative embodiment thereto (not illustrated), the pool base 9"" can also be designed without a concrete slab 91"". For example, individual foundation pillars can be introduced here into the underlying soil, said foundation pillars accordingly forming the bearing pedestals 92"".

In the fifth embodiment of the pool 1"" that is illustrated and described here, a surrounding element 93"" is arranged in an encircling manner around the upper region of the boundary wall 3"". Said surrounding element 93"" serves, for example as an underlying surface for a region which can be walked on and which encircles the pool 1"". Natural stones or tiles, inter alia, can be applied to said region which can be walked on. The surrounding element 93"" therefore does not belong to the pool shell but rather serves for connecting the pool shell to its surroundings. Furthermore, the surrounding element 93"" is arranged here spaced apart from the boundary wall 3"". The distance between surrounding element 93"" and boundary wall 3"" is ensured by a spacer structure 931"". The region illustrated in FIG. 6 by reference sign VII is illustrated in detail in FIG. 7 described below.

Figure 7:
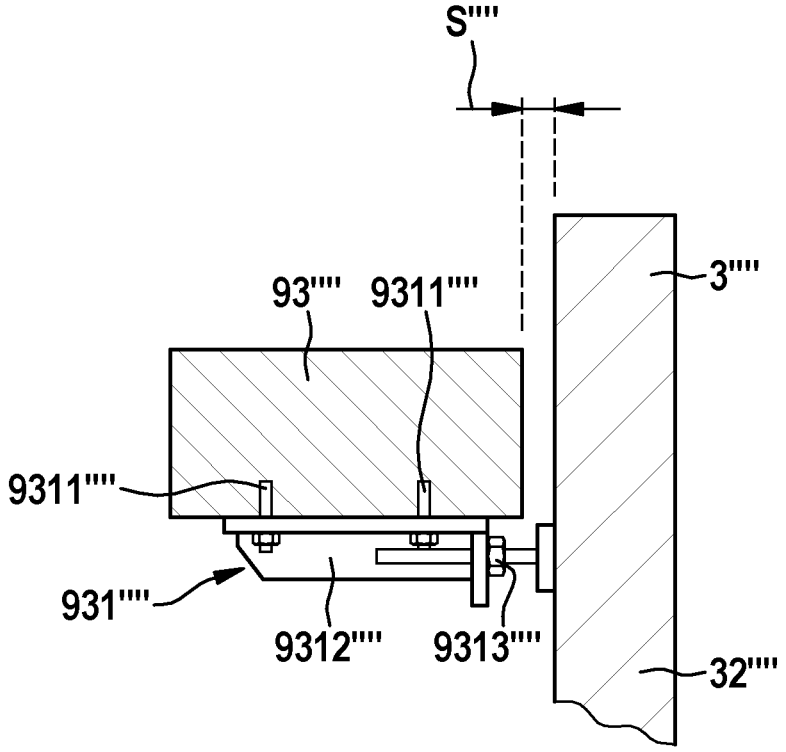
FIG. 7 shows a sectioned detailed view of the fifth embodiment of a pool according to the invention according to FIG. 6.

FIG. 7 shows a sectioned detail view of the fifth embodiment of the pool 1"" according to the invention according to FIG. 6. FIG. 7 shows the detail, which is denoted by VII in FIG. 6, in detail. The upwardly facing edge of the boundary wall 3"", on which a surrounding element 93"" is arranged, can be seen here. The surrounding element 93"" encircles the boundary wall 3"". A gap S"" is located between the surrounding element 93"" and the wide sidewall 32"". The surrounding element 93"" is therefore provided spaced apart from the pool shell. The surrounding element 93"" is connected to the wide sidewall 32"" by a spacer structure 931"". FIG. 7 shows such a spacer structure 931"". Since the surrounding element 93"" encircles the pool shell, a plurality of such spacer structures 931"" are arranged over the circumference of the pool shell and the surrounding element 93"" and serve to permanently realize the gap S"". In the embodiment illustrated, the spacer structure 931"" is fixedly connected to the surrounding element 93"" via two connecting elements 9311"". The connecting elements 9311"" can be formed, for example, by screws which are screwed with or without dowels into the surrounding element 93"". The connecting elements 9311"" are simultaneously fixedly connected to the support 9312"" of the spacer structure 931"". An adjustment element 9313"" is likewise connected to the support 9312"", said adjustment element being fastened here to the edge of the support 9312"" that points to the right. The adjustment element 9313"" comprises a threaded bolt which points to the left in the illustration and is screwed into the support 9312"". By means of said screw connection, the length of the adjustment element 9313, which length protrudes over the support 9312"", is adjustable. The adjustment element 9313"" furthermore has a contact element which points to the right and lies against the wide sidewall 32"". The width of the gap S"" can be adjusted by the adjustment element 9313"". Compressive forces can be transmitted between the surrounding element 93"" and the wide sidewall 32"" via the spacer structure 931"". Force flows via the adjustment element 9313"" which lies with its contact element against the pool shell. Said contact element can be fastened to the pool shell, for example by means of a screw connection or adhesive bonded joint, or else can be in contact therewith via a frictional connection. In this embodiment, the surrounding element 93"" is connected to the pool shell via a plurality of spacer structures 931"". Compressive forces can thus be dissipated from the pool shell to the surrounding element 93"" and vice versa at a plurality of points distributed around the circumference of the pool shell. The spacer structures 931"" used for the transmission of force are therefore arranged spaced apart from one another on the pool shell and are each in contact by their contact element with the pool shell. Between the individual spacer structures 931"" there are therefore regions of the boundary wall at which force is not transmitted between surrounding element 93"" and pool shell. In these regions, the pool shell is stressed solely by the bending stresses which are produced by the water located in the internal volume 4"". The spaced-apart arrangement of a surrounding element 93"" around the pool shell thus does not constitute a supporting device or substructure which absorbs the bending stresses in the pool shell resulting from the water pressure in the interior of the pool. Even in the case of the arrangement of a surrounding element 93"" with the aid of a plurality of spacer structures 931"", as illustrated and described here, the pool shell is formed in a self-supporting manner.

Preferred embodiments of the present invention have been described above, but the present invention is not limited to the previously described preferred embodiments. Diverse modifications in the configuration can be undertaken without departing from the invention as specified within the scope of the subsequent claims.

LIST OF REFERENCE SIGNS

1; 1'; 1"; 1'"; 1"" Pool
2; 2'; 2"; 2'"; 2"" Baseplate
3; 3'; 3"; 3'"; 3"" Boundary wall
31; 31'; 31'"; 31"" Longitudinal sidewall
32; 32'; 32"" Wide sidewall
4; 4"; 4'"; 4"" Internal volume
41 Depth
42; 42'; 42'" Free internal length
43; 43'" Free internal width
5 Treatment plant
51 Inlet
52 Outlet
53 Treatment element
6" Collecting collar
61" Base part
62" Wall part
63" Drainage channel
8'" Separating point
81'" Clamping device
811'" Angular element
812'" Fastening opening
813'" Bore
82'" Sealing means
83'" Groove
9"" Pool base
91"" Concrete slab
92"" Bearing pedestal

93"" Surrounding element
931"" Spacer structure
9311"" Connecting element
9312"" Support
9313"" Adjustment element
S"" Gap

The invention claimed is:

1. A pool for receiving one or more persons for the performance of sporting or recreational activities, comprising:

at least one bottom plate;

a boundary wall, wherein the bottom plate and the boundary wall enclose an inner volume which is fillable with water during operation of the pool; and a treatment unit for treatment of the water contained in the inner volume, the treatment unit comprising an inlet connected to the inner volume, an outlet connected to the inner volume, and a treatment device arranged in the direction of flow of the water between the inlet and the outlet;

wherein the bottom plate and the boundary wall are each constructed of one or more monolithic natural stones, and said monolithic natural stones are adhesively joined to one another within the bottom plate, the boundary wall and at the connecting surfaces between the bottom plate and the boundary wall in a materially bonded and watertight manner;

wherein the bottom plate together with the boundary wall are adapted to absorb pressure generated by the water present in the inner volume during operation of the pool without the need for a load-bearing full-surface supporting substructure provided in addition to the boundary wall; and wherein the inner volume has a depth of at least 0.5 m and the inner volume exhibits a free inner length of at least 2 m and a free inner width of at least 2 m, wherein the free inner length is arranged at right angles to the free inner width.

2. The pool according to claim 1, wherein the boundary wall is rectangular in a top view of the pool and is constructed from two long side walls and two broadside walls, wherein the longitudinal side walls and the broadside walls are arranged at right angles to each other and to the bottom plate.

3. The pool according to claim 1, wherein in a top view of the pool, the boundary wall exhibits a round, oval or polygonal shape or a mixture of these shapes; and the treatment unit is arranged outside the boundary wall and the bottom plate and wherein the inlet and the outlet are connected in a watertight manner at recesses in the boundary wall.

4. The pool according to claim 1, wherein the materially bonded joints between the individual monolithic natural stones of the bottom plate and boundary wall have substantially the same strength, as the natural stone itself.

5. The pool according to claim 1, wherein the boundary wall has a wall thickness corresponding to the square root of the product of a design constant with the depth cubed, with the design constant being dependent on the maximum material stress strength of the natural stone.

6. The pool according to claim 1, wherein a collecting collar is arranged circumferentially on the outer side of the boundary wall facing away from the inner volume, which collecting collar is provided for collecting water escaping from the inner volume beyond the boundary wall during operation, wherein the inlet of the treatment unit is fluidically connected to the collecting collar, and further wherein the collecting collar is constructed of monolithic natural stones and the connection of the monolithic natural stones of the collecting collar to each other as well as the connection of the collecting collar with the boundary wall is implemented exclusively by material bonding, further wherein the collecting collar comprises substantially horizontally arranged bottom parts and substantially vertically arranged wall parts, wherein the bottom parts and the wall parts together with the boundary wall form a drainage channel, and wherein the inlet is fluidically connected to a recess in a bottom part.

7. The pool according to claim 1, wherein the pool has at least one separation area which separates the bottom plate and the boundary wall into at least two pool parts, with the at least two pool parts being connected to one another at the separation area by clamping devices, wherein the pool parts themselves are constructed from monolithic natural stones connected to one another exclusively by material bonding, and a sealing means is inserted at the separation area, which is deformed by the clamping devices and seals the at least two pool parts towards each other, wherein the separation area also separates the collecting collar.

8. The pool according to claim 1, wherein the monolithic natural stones of the bottom plate and of the boundary wall are made of granite, wherein all the monolithic natural stones used in the pool are made of the same type of granite or being made of different types of granite, and the surfaces of the monolithic natural stones formed from granite are surface treated.

9. The pool according to claim 1, wherein a pool foundation is provided, which is arranged below the bottom plate and comprises a plurality of bearing pedestals, with the bearing pedestals being arranged at a distance from one another, and with the bottom plate resting zonally on the bearing pedestals, and the pool foundation further comprises a concrete slab on which the bearing pedestals are positioned in spaced apart relationship.

10. The pool according to claim 1, wherein a surrounding element is provided, which at least partially surrounds the boundary wall, and wherein the surrounding element is in contact with the boundary wall by means of at least one spacer construction, wherein the spacer construction is in contact with the boundary wall via a circular contact element, which is adapted to transmit forces between the boundary wall and the surrounding element, further wherein the contact element can abut in the upper half of the boundary wall, further in the upper third of the boundary wall.

11. The pool according to claim 1, wherein the monolithic natural stones forming the bottom plate and the boundary wall, together with the material bonding between the monolithic natural stones, absorb at least part of the forces arising from the bending tensile stresses generated in the bottom plate and the boundary wall due to the pressure generated by the water present in the inner volume during the operation of the pool.

12. The pool according to claim 10, wherein the pool foundation and the surrounding element in combination with at least one spacer structure absorb a part of the forces generated by the bending tensile stresses generated in the bottom plate and the boundary wall by the pressure generated due to the water present in the inner volume during the operation of the pool wherein the bottom plate and the boundary wall absorb another part of these forces.

13. A method for manufacturing a pool according to claim 1, comprising the steps of preparing a bottom plate, wherein the bottom plate is composed of a plurality of monolithic natural stones, and wherein the connection between the monolithic natural stones of the bottom plate is made exclusively by material bonding;

providing recesses into a boundary wall and/or the bottom plate, wherein the recesses are provided for connecting a treatment unit;

arranging the boundary wall at the edge of the bottom plate wherein the boundary wall extends vertically upwards starting from the bottom plate and wherein the boundary wall is closed in itself and, together with the bottom plate, water tightly encloses an inner volume which can be filled with water during operation of the pool, wherein the boundary wall is composed of a plurality of monolithic natural stones, and wherein the connection between the monolithic natural stones of the boundary wall and the bottom plate is implemented exclusively by material bonding; and connection of the treatment unit, which comprises an inlet connected to the inner volume, an outlet connected to the inner volume, and a treatment means arranged in the direction of flow of the water between the inlet and the outlet, wherein the inlet and the outlet are connected at the recesses in a watertight manner.

* * * * *